US011584611B2

(12) United States Patent
Cheng

(10) Patent No.: US 11,584,611 B2
(45) Date of Patent: Feb. 21, 2023

(54) ROTARY WIRE-RECEIVING RACK

(71) Applicant: APOLLO ELECTRICAL TECHNOLOGY COMPANY LIMITED, Taipei (TW)

(72) Inventor: Chi-Wen Cheng, Taipei (TW)

(73) Assignee: APOLLO ELECTRICAL TECHNOLOGY COMPANY LIMITED, Taipei (TW)

( * ) Notice: Subject to any disclaimer, the term of this patent is extended or adjusted under 35 U.S.C. 154(b) by 157 days.

(21) Appl. No.: 17/147,985

(22) Filed: Jan. 13, 2021

(65) Prior Publication Data

US 2022/0219938 A1 Jul. 14, 2022

(51) Int. Cl.
*B65H 75/30* (2006.01)
*B65H 75/06* (2006.01)
*B65H 75/28* (2006.01)

(52) U.S. Cl.
CPC ..... *B65H 75/30* (2013.01); *B65H 75/06* (2013.01); *B65H 75/28* (2013.01); *B65H 2402/35* (2013.01); *B65H 2402/412* (2013.01); *B65H 2405/121* (2013.01)

(58) Field of Classification Search
CPC ..... B65H 75/06; B65H 75/28; B65H 75/30; B65H 2402/35; B65H 2402/412; B65H 2405/121
See application file for complete search history.

(56) References Cited

U.S. PATENT DOCUMENTS 4,747,561 A * 5/1988 Sweeny ..... B65H 75/406 242/608.5
6,142,405 A * 11/2000 Black ..... H02G 11/02 242/402
6,286,777 B1 * 9/2001 Black ..... H02G 11/02 242/402
7,552,888 B2 * 6/2009 Glenn ..... B65H 75/4492 242/405
2004/0007640 A1 * 1/2004 West ..... B65H 75/06 242/402
2009/0108113 A1 * 4/2009 Chen ..... B65H 75/06 242/129
2011/0101146 A1 * 5/2011 Bordignon ..... B65H 75/06 242/405.2
2017/0101288 A1 * 4/2017 Einck ..... B65H 75/06

* cited by examiner

*Primary Examiner* — Sang K Kim
(74) *Attorney, Agent, or Firm* — Muncy, Geissler, Olds & Lowe, P.C.

(57) ABSTRACT

A rotary wire-receiving rack includes a winding structure, a shaft, a first handle, a lid, a locking slider, and a second handle. The winding structure includes two bars arranged longitudinally in parallel and two rods arranged horizontally in parallel for winding cables. Both ends of the two rods are linked to the bars respectively. The shaft is arranged parallel to and located between the rods. The shaft is pivoted on the bars. The first handle and the lid are respectively fixed at the two ends of the shaft. The lid has a locking hole, and the locking slider is slidably installed on the shaft near the locking hole. The locking slider is formed with a locking pin that cooperates with the locking hole. The second handle is pivoted at the end of the bar which closing to the locking hole and having a recess for clamping a cable.

10 Claims, 5 Drawing Sheets

ROTARY WIRE-RECEIVING RACK

FIELD

The present invention relates to a wire-receiving device, especially to a rotary winding wire-receiving rack.

BACKGROUND

Wires, including fiber optic cables, electric cables, and so forth, are mainly used for linking to electronic devices, power transmission, or electronic signals and are familiar and essential tools in daily life. When users need to wind or release wires, users usually pull, wind, and receive wires manually and clamp them with ropes afterward. However, it is time-consuming, demanding, and ineffective for users to wind and receive wires; hence, it requires improvement.

SUMMARY

The main purpose of the present invention is to provide a rotary wire-receiving rack to wind and receive cables.

To achieve the above purpose, the present invention provides a rotary wire-receiving rack comprising: a winding structure includes two bars and two rods, the bars are arranged longitudinally in parallel, the rods are arranged horizontally in parallel for winding cables, and both ends of the two rods are respectively linked to the bars; a shaft is pivoted on the bars, arranged parallel to, and located between the rods; a first handle is fixed at one end of the shaft; a lid with a locking hole is fixed at the other end of the shaft; a locking slider is installed on the shaft near the locking hole, having a locking pin that cooperates with the locking hole; and a second handle is pivoted at the end of the bar close to the locking hole, and the bar has a securing portion.

The followings are beneficial effects of the present invention. The winding structure is pivoted on the shaft, and the second handle and the first handle are arranged on the winding structure and the shaft. To wind and receive wires without effort, the user secures one end of the cable on the rods of the winding structure, and then one hand grasps and holds the first handle while the other hand reaches through the second handle to rotate the winding structure without ropes to clamp, the other free end of the cable is secured firmly on securing portion to be fixed when the user has winded and received the cable. Therefore, the present invention is equipped with the merits of uncomplicated structures and simple operations. Furthermore, the user can lock the winding structure to the shaft without effort by the locking slider so that the winding structure can neither respectively rotate around the shaft nor be released from the shaft to respectively rotate around the shaft.

DETAILED DESCRIPTION

Figure 1:
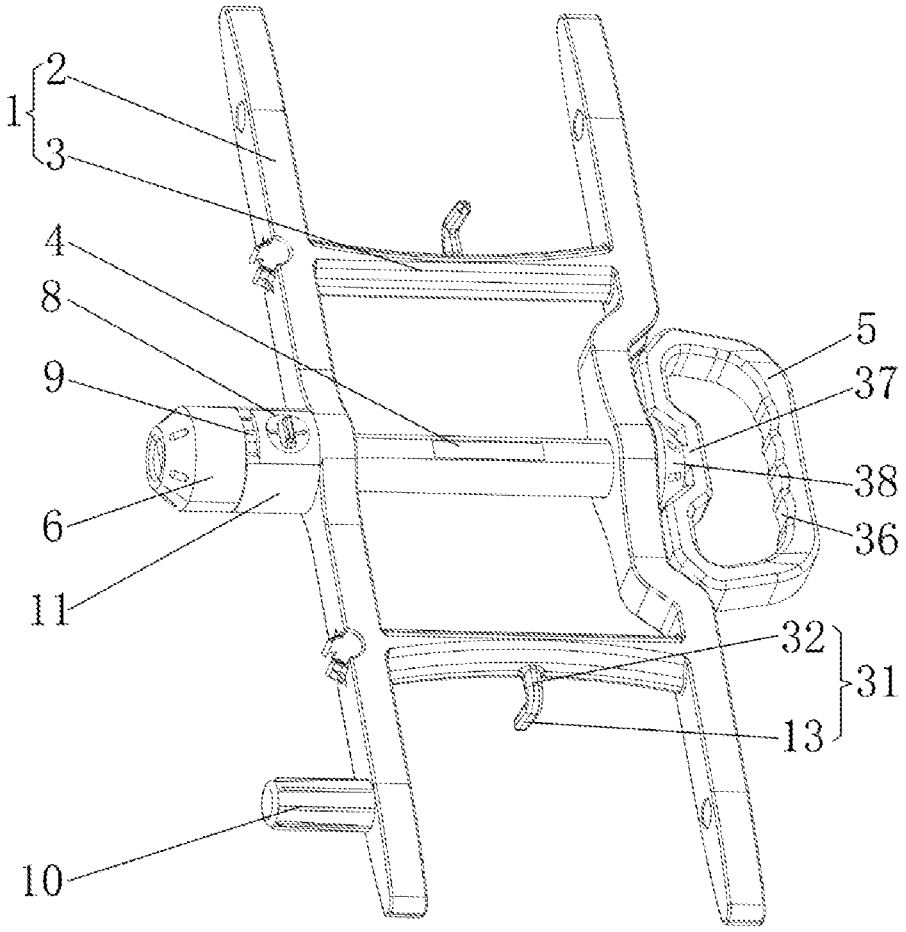
FIG. 1 is an assembled three-dimensional schematic diagram of the rotary wire-receiving rack.
Figure 2:
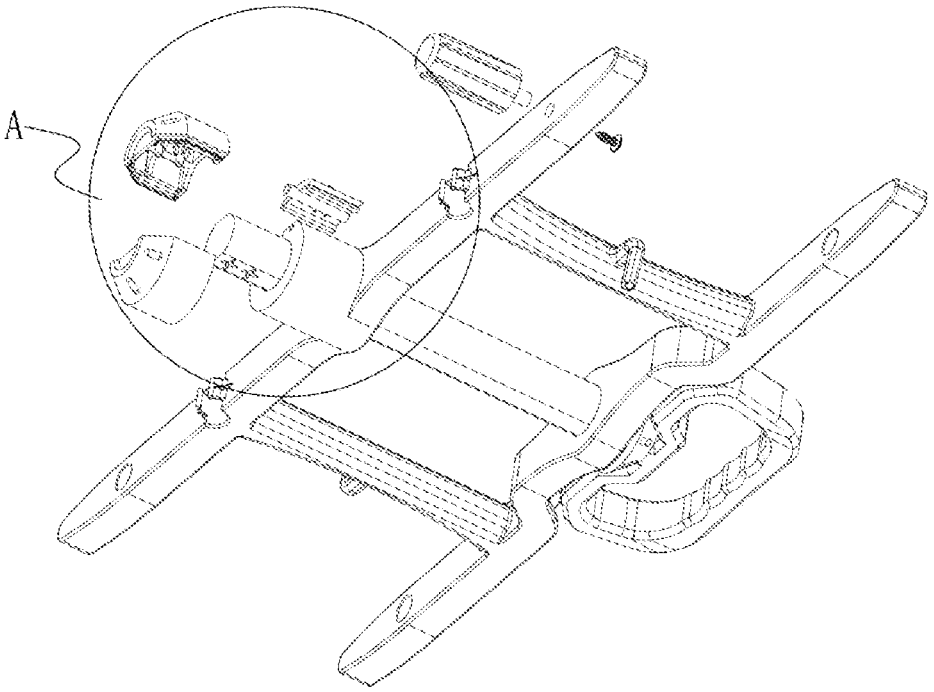
FIG. 2 is an exploded three-dimensional schematic diagram of the rotary wire-receiving rack.
Figure 3:
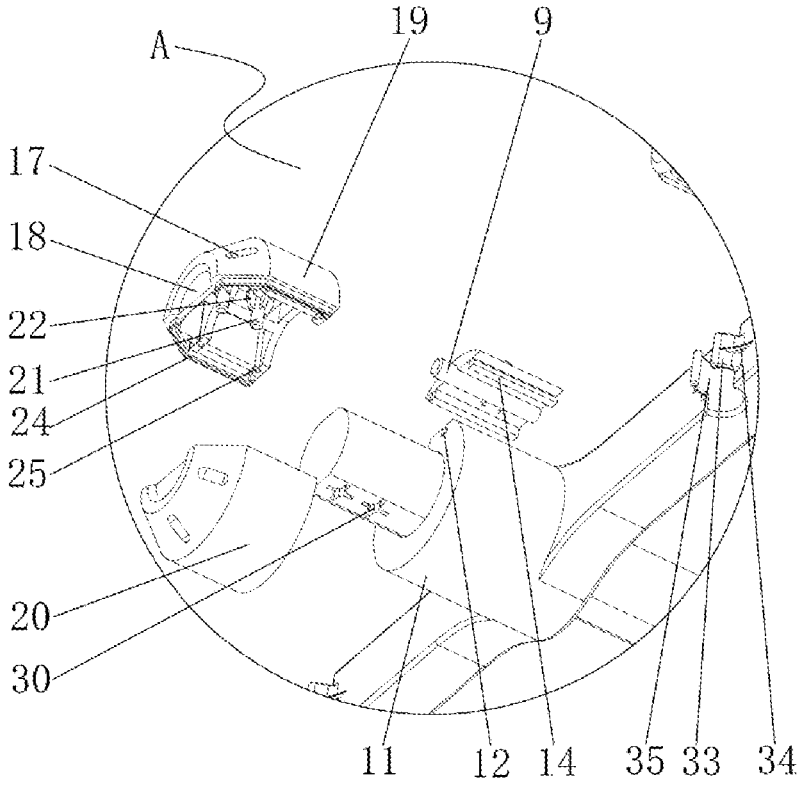
FIG. 3 is a partially enlarged view of A in FIG. 2.
Figure 4:
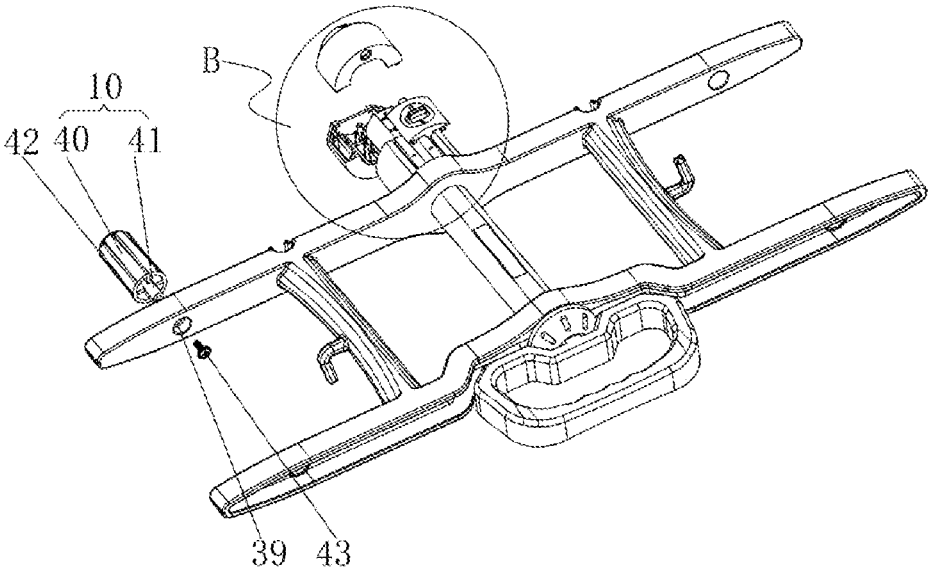
FIG. 4 is an exploded three-dimensional schematic diagram of the rotary wire-receiving rack.
Figure 5:
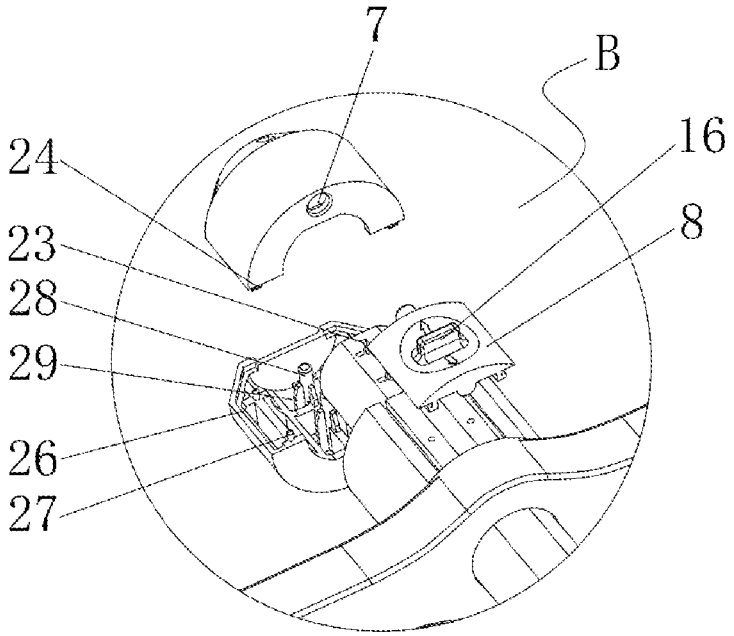
FIG. 5 is a partially enlarged view of B in FIG. 4.

FIG. 1 to FIG. 5 illustrate the embodiment of the present invention, a rotary wire-receiving rack, wherein comprises a winding structure 1, a shaft 4, a first handle 5, a lid 6, a locking slider 8, and a second handle 10. The winding structure 1 includes two bars 2 and two rods 3. The bars 2 are arranged longitudinally in parallel, and the rods 3 are arranged horizontally in parallel for winding cables. Both ends of the two rods 3 are linked to the bars 2 respectively. In other words, it is able to constitute an H-shaped structure solely by each of the rod 3 and the two bars 2. The shaft 4 is parallel to and located between the two rods 3. The shaft 4 is pivoted on the bars 2 to rotate the winding structure 1. The two ends of the shaft 4 respectively link to the first handle 5 and the lid 6. A locking hole 7 is arranged on the lid 6, and the locking slider 8 is slidably installed on the bar 2 that is near the locking hole 7.

A locking pin 9 that cooperates with the locking hole 7 is on the locking slider 8. The second handle 10 is pivoted at the end of the bar 2 which is close to the locking hole 7, and a securing portion for securing a cable is further formed on the bar 2.

On the side of the bar 2, close to the lid 6, forms a flange 11 faces the locking 7. The shaft 4 is rotatably penetrated and arranged in the flange 11. There are two ditches 12 with L-shaped cross-sections on flange 11. The bottom of the locking slider 8 forms two first blocks 14 with L-shaped cross-sections, the two first blocks 14 are respectively slidably installed in the two ditches 12. The locking pin 9 is on the side of the locking slider 8 facing the locking hole 7. The top of the locking slider 8 has a switch cam 16, by which users can operate the locking slider 8, and it enables the locking pin 9 to plug in or pull out from the locking hole 7. The locking slider 8, the lid 6, and the bar 2 will be all fixed, and be not rotated when the locking pin 9 is plugged in the locking hole 7. Besides, since the lid 6 is connect to the shaft 4 firmly, the shaft 4 is locked on the winding structure 1, and it limits the shaft 4 to rotate around the winding structure 1; on the other hand, the winding structure 1 is able to rotate around the shaft 4 when the locking pin 9 is pulled out from the locking hole 7. Therefore, the present invention is equipped with the merits of uncomplicated structures and simple operations.

The lid 6 is a hollow cylinder and one end of the lid 6 facing the first handle 5 leans against the flange 11. The periphery of the other end of the lids 6 are chamfered, and a plurality of slots 17 are evenly arranged along with the periphery of the other end. On the other end of the lid 6 further forms a bearing platform 18. Users can install the lid 6 with tools in actual use. For instance, users can use the corresponding bulge of the tools to reach into the slot 17 and the bearing platform 18.

The lid 6 includes an upper cover 19 and a lower cover 20. A first fixing post 21 is on an inner side of the upper cover 19, and a first stiffener 22 connects the first fixing post 21 to the inner side of the upper cover 19. An upper part of the shaft 4 forms a first fixing hole 23 which the first fixing post 21 and the first stiffener 22 are able to plug in firmly. The periphery of the lower side of the upper cover 19 further forms a strip 24 and a second fixing hole 25, the periphery of the upper side of the lower cover 20 arranges a guiding slot 26 that cooperates with the strip 24 and a second fixing post 27 that cooperates with the second fixing hole 25. Due to the cooperation of the strip 24 and the guiding slot 26, it leads and guides to combine the upper cover 19 and the lower cover 20. Due to the cooperation of the second fixing post 27 and the second fixing hole 25, it enables the upper cover 19 and the lower cover 20 to be connected firmly. The inner side of the lower cover 20 further forms a third fixing post 28, and a second stiffener 29 links the third fixing post 28 to an inner side of the lower cover 20. A lower part of the shaft 4 forms a third fixing hole 30 which the third fixing post 28 and the second stiffener 29 are able to plug in firmly.

An L-shaped fixing lead 31 that secures cables is formed on each rod 3, including a first bending part 32 and a second bending part 13. An included angle between the first bending part 32 and the second bending part 13 is 77°. An end of the cable can be on the first bending part 32 firmly by knots; however, knots cannot fit the bending part 32 well because rubbers or other materials with harder textures cover the surfaces of cables. To protect knots from sliding away from the fixing lead 31, the present invention ties knots on the first bending part 32, and the second bending part 13 will stop the knots from sliding away.

The securing portion has a recess 35 with semicircle cross-section formed on the bar 2, and there are two plates 33 and two third stiffeners 34 on two sides of the recess 35 respectively. The two plates 33 are formed on an opening of a side margin of the recess 35, and each third stiffener 34 is respectively between the plate 33 and the bar 2. The two plates 33 are arc-shaped and link to an inner sidewall of the recess 35 to form an arc with a major arc cross-section. The diameter of the major arc may be a little smaller than the external diameter of cables. Users can directly firm and stuck an end of a cable in the recess 35 after winding the cable.

The first handle 5 is ring-shaped, and there is a finger-like holder 36 for grasping and holding on an inner sidewall of the first handle 5 that is away from the shaft 4. Four arc sections of the finger-like holder 36 are on an inner sidewall of the shaft 4 to allow users to fit their index fingers, middle fingers, ring fingers, and pinkies respectively in the four arc sections when they grasp and hold the first handle 5. The four arc sections of the finger-like holder 36 make users grasp and hold comfortably and firmly. An inner sidewall of the first handle 5 shapes an U-form part 37 faceing the shaft 4. An antifriction block 38 is arranged on the U-form part 37. The antifriction block 38 links to the shaft 4 and leans against a corresponding sidewall of the bar 2. The texture of the antifriction block 38 may be attrition-resistant rubbers.

An end of the bar 2 forms a stepped hole 39. The diameter of the stepped hole 39 close to the first handle 5 is bigger than the diameter of the stepped hole 39 that is away from the first handle 5. The second handle 10 has a grip 40 and a pole 41. The grip 40 is a cylinder with a plurality of ribs 42, and the ribs 42 enable users to grasp and hold much more firmly. From the stepped hole 39 that is away from a side of the first handle 5, the pole 41 plugs into the stepped hole 39 and corresponds to the smaller stepped hole 39. A screw 43 is penetrated and arranged in the stepped hole 39 as well. The head of the screw 43 is arranged in the bigger stepped hole 39, and the largest external diameter of the head is longer than the diameter of the smaller stepped hole 39. A thread of the screw 43 secures and screws the pole 41 and enables the pole 41 to be rotatably installed in the stepped hole 39.

Instruction of the present invention is securing one end of the cable on one of the rods 3, then grasping and holding the first handle 5, and operating the second handle 10 to enable the winding structure 1 to rotate around the shaft 4. The cable is winded on the two rods 3, the other end of the cable is secured firmly on the securing portion after the cable has been winded. Finally, the locking slider 8 is pushed to plug the locking pin 9 into the locking hole 7, and the winding structure 1 will not rotate around the shaft 4.

The description above is merely an embodiment of the present invention, and it does not limit the scope of patent protection; therefore, modifications of equivalent effects based on the present specification and drawings should be deemed to be included in the scope of the present invention.

What is claimed is:

1. A rotary wire-receiving rack comprising:

a winding structure including two bars and two rods, the bars arranged longitudinally in parallel, the rods arranged horizontally in parallel for winding cables, both ends of the two rods respectively linked to the bars;

a shaft pivoted on the bars, arranged parallel to and located between the rods;

a first handle fixed at one end of the shaft;

a lid with a locking hole fixed at the other end of the shaft;

a locking slider installed on the shaft near the locking hole, having a locking pin that cooperates with the locking hole; and a second handle pivoted at one end of the bar close to the locking hole, the bar having a securing portion.

2. The rotary wire-receiving rack of claim 1, wherein a flange is formed on the bar close to the lid facing the sidewall of the locking hole, the shaft is rotatably penetrated and arranged in the flange, the flange forms two ditches with L-shaped cross-sections, the bottom of the locking slider forms two first blocks with L-shaped cross-sections, and the two first blocks are respectively slidably installed in the two ditches.

3. The rotary wire-receiving rack of claim 2, wherein the top of the locking slider has a switch cam.

4. The rotary wire-receiving rack of claim 2, wherein the lid is a hollow cylinder, one end of the lid facing the first handle leans against the flange, the periphery of the other end of the lid is chamfered, and a plurality of slots are evenly arranged along with the periphery of the other end, and a bearing platform is formed on the other end of the lid.

5. The rotary wire-receiving rack of claim 2, wherein the lid includes an upper cover and a lower cover, a first fixing post is formed on an inner side of the upper cover, a first stiffener connects the first fixing post to the inner side of the upper cover, an upper part of the shaft forms a first fixing hole which the first fixing post and the first stiffener are able to plug in firmly, the periphery of the lower side of the upper cover further forms a strip and a second fixing hole, the periphery of the upper side of the lower cover arranges a guiding slot that cooperates with the strip, and a second fixing post that cooperates with the second fixing hole, an inner side of the lower cover further forms a third fixing post, a second stiffener connects the third fixing post to the inner side of the lower cover, and a lower part of the shaft forms a third fixing hole which the third fixing post and the second stiffener are able to plug in firmly.

6. The rotary wire-receiving rack of claim 2, wherein a fixing lead is formed on each of the rod to secure cables, each of the fixing lead is L-shaped and includes a first bending part and a second bending part, and an included angle between the first bending part and the second bending part is 77°.

7. The rotary wire-receiving rack of claim 1, wherein the securing portion has a recess, the recess is formed on the bar with semicircle cross-section, two sides of the recess respectively forms two plates and two third stiffeners, the two plates are on an opening of a side margin of the recess, and each third stiffener is between the plate and the bar.

8. The rotary wire-receiving rack of claim 7, wherein the two plates are arc-shaped, and link to an inner sidewall of the recess to form an arc.

9. The rotary wire-receiving rack of claim 7, wherein the first handle is ring-shaped, a finger-like holder for grasping and holding is on an inner sidewall of the first handle that is away from the shaft, the inner side of the first handle shapes an U-form part facing the shaft, an antifriction block is arranged at the U-form part, and the antifriction block links to the shaft and leans against a corresponding sidewall of the bar.

10. The rotary wire-receiving rack of claim 9, wherein an end of the bar forms a stepped hole, the diameter of the stepped hole that is close to the first handle is bigger than the diameter of the stepped hole that is away from the first handle, the second handle has a grip and a pole, the grip is a cylinder with a plurality of ribs, the pole plugs into the stepped hole from the stepped hole that is away from a side of the first handle, a screw whose head is arranged in the bigger stepped hole, and a thread of the screw secures and screwing the pole.

* * * * *